US010022967B2

(12) United States Patent
Mizuno et al.

(10) Patent No.: US 10,022,967 B2
(45) Date of Patent: Jul. 17, 2018

(54) LIQUID JETTING APPARATUS

(71) Applicant: BROTHER KOGYO KABUSHIKI KAISHA, Nagoya-shi, Aichi-ken (JP)

(72) Inventors: Taisuke Mizuno, Yokkaichi (JP); Hideki Hayashi, Nagoya (JP); Keita Sugiura, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/465,711

(22) Filed: Mar. 22, 2017

(65) Prior Publication Data

US 2017/0282562 A1 Oct. 5, 2017

(30) Foreign Application Priority Data

Mar. 31, 2016 (JP) ..... 2016-071147

(51) Int. Cl.

| | |
|---|---|
| ***B41J 2/155*** | (2006.01) |
| ***B41J 2/045*** | (2006.01) |
| ***B41J 2/145*** | (2006.01) |
| ***B41J 2/21*** | (2006.01) |

(52) U.S. Cl.

CPC ..... *B41J 2/155* (2013.01); *B41J 2/04505* (2013.01); *B41J 2/04586* (2013.01); *B41J 2/145* (2013.01); *B41J 2/2146* (2013.01); *B41J 2202/19* (2013.01); *B41J 2202/20* (2013.01)

(58) Field of Classification Search

CPC . B41J 2/155; B41J 2/145; B41J 2/2146; B41J 2/04586; B41J 2/04505; B41J 2202/19; B41J 2202/20; B41J 2202/21

See application file for complete search history.

(56) References Cited

U.S. PATENT DOCUMENTS 6,328,418 B1 * 12/2001 Yamada ..... B41J 2/15 347/12
8,118,405 B2 * 2/2012 Xie ..... B41J 2/155 347/49

(Continued)

FOREIGN PATENT DOCUMENTS

| | | |
|---|---|---|
| JP | 2007-160566 A | 6/2007 |
| JP | 2015-131447 A | 7/2015 |
| JP | 2015-136866 A | 7/2015 |

*Primary Examiner* — Henok Legesse

(74) *Attorney, Agent, or Firm* — Scully, Scott, Murphy & Presser, PC

(57) ABSTRACT

A liquid jetting apparatus jetting a liquid onto a recording medium conveyed in a first direction includes head units arranged in a second direction orthogonal to the first direction. One head unit includes nozzle chips; one nozzle chip has a nozzle arrangement area wherein nozzles are aligned in a third direction crossing the first and second directions. The nozzle chip is arranged to be shifted relative to another nozzle chip in a direction crossing the first and second directions and different from the third direction. The head unit has a first overlapping portion wherein nozzle arrangement areas of first and second nozzle chips included in the nozzle chips partially overlap with each other in the first direction. The liquid jetting apparatus has a second overlapping portion wherein nozzle arrangement areas of third and fourth nozzle chips included in the head units partially overlap with each other in the first direction.

15 Claims, 15 Drawing Sheets

(56) References Cited

U.S. PATENT DOCUMENTS

| | | | | |
|---|---|---|---|---|
| 2005/0001877 | A1* | 1/2005 | Chikanawa | B41J 2/1433<br>347/42 |
| 2006/0066678 | A1* | 3/2006 | Rai | B41J 2/14233<br>347/54 |
| 2007/0132815 | A1 | 6/2007 | Sakaida | |
| 2015/0197090 | A1* | 7/2015 | Akahane | B41J 2/2103<br>347/47 |
| 2015/0202866 | A1* | 7/2015 | Akahane | B41J 2/14<br>347/44 |

* cited by examiner

LIQUID JETTING APPARATUS

CROSS REFERENCE TO RELATED APPLICATION

The present application claims priority from Japanese Patent Application No. 2016-071147 filed on Mar. 31, 2016 the disclosure of which is incorporated herein by reference in its entirety.

BACKGROUND

Field of the Invention

The present invention relates to a liquid jetting apparatus.

Description of the Related Art

Conventionally, there is known an ink-jet head of a line type, as a liquid jetting apparatus. This head is provided with a plurality of head units (ink-jet recording heads) arranged side by side in the width direction of a recording sheet which is orthogonal to a conveyance direction of the recording sheet.

Each of the head units (hereinafter referred to as "one head unit", as appropriate) has a plurality of nozzle chips (head bodies) which are arranged side by side in the width direction of the recording sheet, and a holder configured to hold the plurality of nozzle chips. The respective nozzle chips extend in an oblique direction crossing (intersecting) both of the conveyance direction and the width direction of the recording sheet, and a plurality of nozzles of each of the nozzle chips are aligned in the oblique direction.

SUMMARY

In the ink-jet head having the above-described configuration, a portion or location between two adjacent nozzle chips, included in the plurality of nozzle chips, in which an end portion of one of the two adjacent nozzle chips and an end portion of the other of the two adjacent nozzle chips are adjacent in the width direction of the recording sheet, tends to have any deviation in the landing positions of liquid droplets jetted respectively from the two adjacent nozzle chips, and/or any unevenness in the concentration (density) due to any difference in the jetting characteristic between the two adjacent nozzle chips, which easily occur in the portion or location between the two adjacent nozzle chips. In order to make the unevenness in the density to be less conspicuous, it is preferred that the two nozzle chips are arranged such that nozzle arrangement areas, in each of which the plurality of nozzles are arranged, of the respective two chips are partially overlapped with each other. Further, as the width of overlapping in which the nozzle arrangement areas are allowed to overlap partially with each other is made to be greater, more effect can be achieved in suppressing the unevenness in the density.

However, in view of assembling the respective head units, it is not possible to arrange two adjacent head units side by side without any gap therebetween, and there is also a limit in decreasing the distance between two nozzle chips belonging to the two adjacent head units, respectively. Accordingly, it is difficult to make the width of overlapping in which the nozzle chips are allowed to overlap partially with each other to be great between the two adjacent head units.

The present teaching has been made in view of the above-described situation, and object of the present teaching is to make the overlapping amount of the nozzle arrangement areas to be great between two nozzle chips belonging to two adjacent head units, respectively.

According to a first aspect of the present teaching, there is provided a liquid jetting apparatus configured to jet liquid onto a recording medium conveyed in a first direction, the liquid jetting apparatus including head units arranged side by side in a second direction orthogonal to the first direction, wherein each of the head units includes nozzle chips, each of the nozzle chips has a nozzle arrangement area in which nozzles are aligned in a third direction crossing both of the first and second directions, in each of the head units, each of the nozzle chips is arranged to be shifted relative to another nozzle chip included in the nozzle chips, in a direction which crosses both of the first and second directions and which is different from the third direction, the nozzle chips included in each of the head units include a first nozzle chip and a second nozzle chip which are adjacent to each other in the second direction, and each of the head units has a first overlapping portion in which the nozzle arrangement area of the first nozzle chip and the nozzle arrangement area of the second nozzle chip partially overlap with each other in the first direction, and the head units include a first head unit and a second head unit which are adjacent to each other in the second direction, and the liquid jetting apparatus has a second overlapping portion in which the nozzle arrangement area of a third nozzle chip and the nozzle arrangement area of a fourth nozzle chip partially overlap with each other in the first direction, the third nozzle chip being included in the nozzle chips of the first head unit and the fourth nozzle chip being included in the nozzle chips of the second head unit.

According to a second aspect of the present teaching, there is provided a liquid jetting apparatus configured to jet liquid onto a recording medium conveyed in a first direction, the liquid jetting apparatus including head units arranged side by side in a second direction orthogonal to the first direction, wherein each of the head units includes nozzle chips, each of the nozzle chips has a nozzle arrangement area in which nozzles are aligned in a third direction crossing both of the first and second directions, the nozzle chips in each of the head units include outermost nozzle chips which are arranged respectively on outermost sides in the second direction to be shifted from each other in the first direction, the nozzle chips included in each of the head units include a first nozzle chip and a second nozzle chip which are adjacent to each other in the second direction, and each of the head units has a first overlapping portion in which the nozzle arrangement area of the first nozzle chip and the nozzle arrangement area of the second nozzle chip partially overlap with each other in the first direction, and the head units include a first head unit and a second head unit which are adjacent to each other in the second direction, and the liquid jetting apparatus has a second overlapping portion in which the nozzle arrangement area of a third nozzle chip and the nozzle arrangement area of a fourth nozzle chip partially overlap with each other in the first direction, the third nozzle chip being included in the nozzle chips of the first head unit and the fourth nozzle chip being included in the nozzle chips of the second head unit.

DESCRIPTION OF THE EMBODIMENTS

Next, an embodiment of the present teaching will be explained, with reference to the drawings as appropriate. Note that in the following explanation, a conveyance direction in which a recording sheet 100 is conveyed is defined as the front/rear direction of a printer 1. Further, a width direction of the width of the recording sheet 100 (sheet-width direction), which is orthogonal to the conveyance direction of the recording sheet 100, is defined as the left/right direction of the printer 1. Furthermore, a direction perpendicular to the sheet surface of FIG. 1 and orthogonal to the front/rear direction and the left/right direction is defined as the up/down direction of the printer 1.

<Schematic Configuration of Printer>

Figure 1:
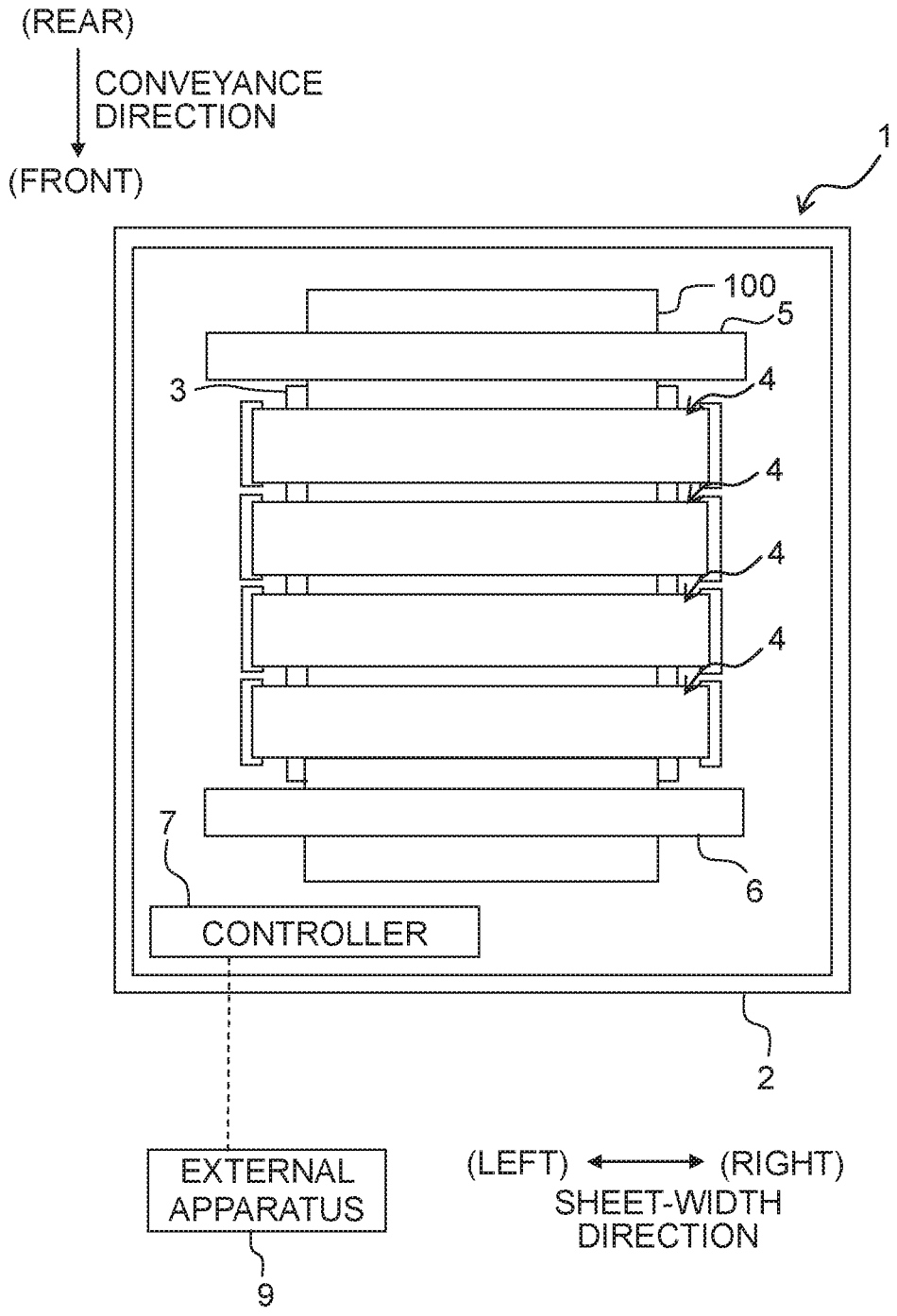
FIG. 1 is a schematic plane view of a printer according to an embodiment of the present teaching.

As depicted in FIG. 1, the printer 1 is provided with a casing 2, a platen 3 accommodated in the inside of the casing 2, four ink-jet head 4, two conveyance rollers 5 and 6, a controller 7, etc.

The recording sheet 100 is place on the upper surface of the platen 3. The four ink-jet heads 4 are arranged side by side in the conveyance direction at a location above the platen 3. An ink is supplied from a non-illustrated ink tank to each of the ink-jet heads 4. Note any one of four color inks (black, yellow, cyan and magenta inks) is supplied to each of the ink-jet heads 4. Namely, the four ink-jet heads 4 are configured to jet the mutually different color inks, respectively.

As depicted in FIG. 1, the two conveyance rollers 5 and 6 are arranged respectively on the rear and front sides with respect to the platen 3. The two conveyance rollers 5 and 6 are driven by non-illustrated conveyance motors, respectively, and convey the recording sheet 100 on the platen 3 in the front direction.

The controller 7 is provided with a CPU (Central Processing Unit), a ROM (Read Only Memory), a RAM (Random Access Memory) and ASIC (Application Specific Integrated Circuit) including a various kinds of control circuits. Further, the controller 7 is connected data-communicatively to an external apparatus 9 such as a PC, and is configured to control various parts or elements of the printer 1, such as the four ink-jet heads 4 and the conveyance motors (not depicted in the drawings), etc., based on a print data transmitted from the external apparatus 9.

More specifically, the controller 7 controls the conveyance motors driving the two conveyance rollers 5 and 6 so as to allow the two conveyance rollers 5 and 6 to convey the recording sheet 100 in the conveyance direction. Further, while performing the conveyance of the recording sheet 100, the controller 7 controls the four ink-jet heads 4 to cause the ink-jet heads 4 to jet the inks towards the recording sheet 100. By doing so, an image, etc., is printed on the recording sheet 100.

<Detailed Configuration of Ink-Jet Head>

Figure 2:
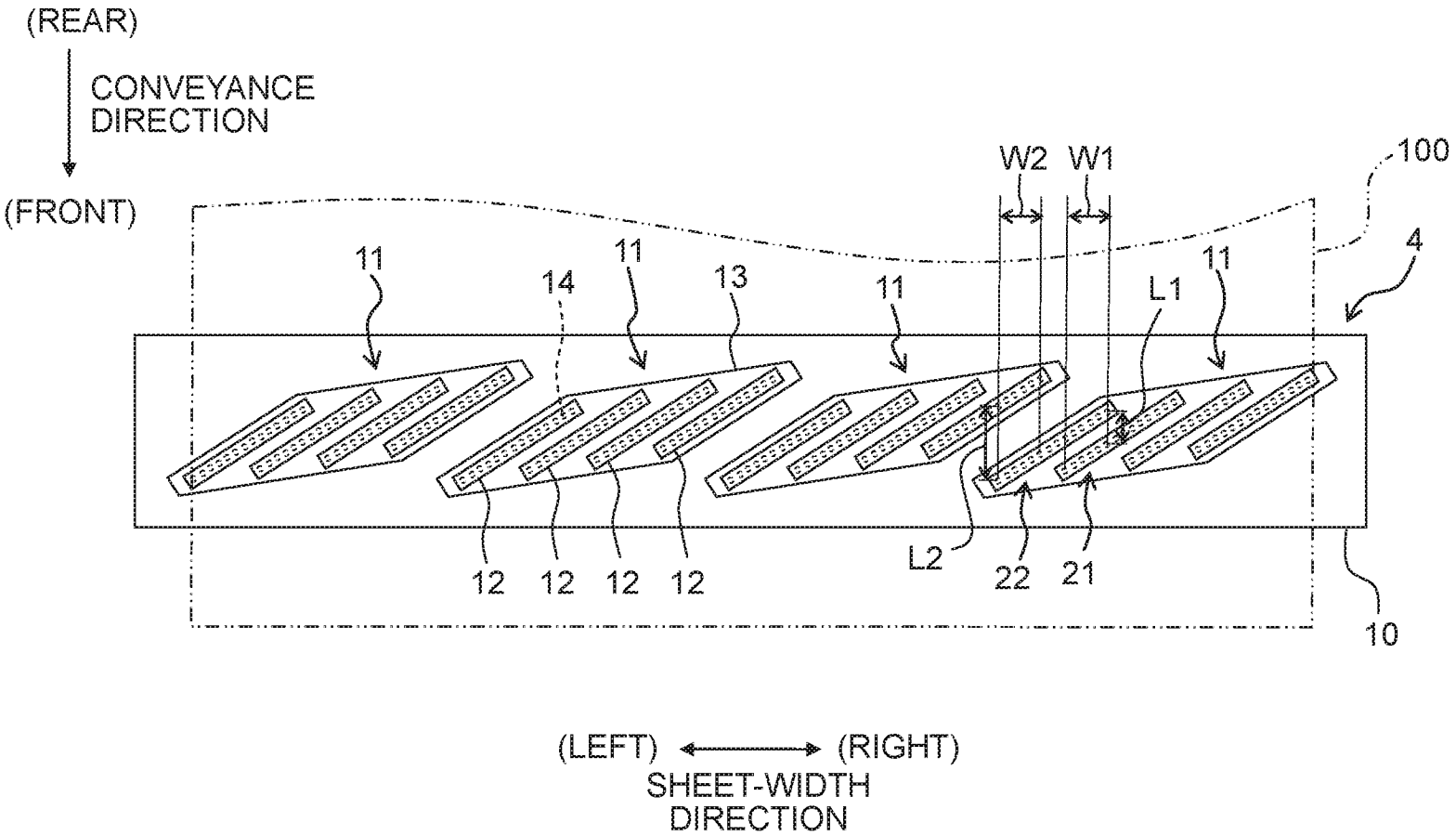
FIG. 2 is a top view of an ink-jet head.

Next, the ink-jet head 4 will be explained in detail. As depicted in FIG. 2, the ink-jet 4 is provided with four head units 11 which are attached to a unit holding plate 10 in a state that the four head units 11 are arranged side by side in the left/right direction. Each of the four head units 11 is connected to a common ink tank (not depicted in the drawings).

Figure 3:
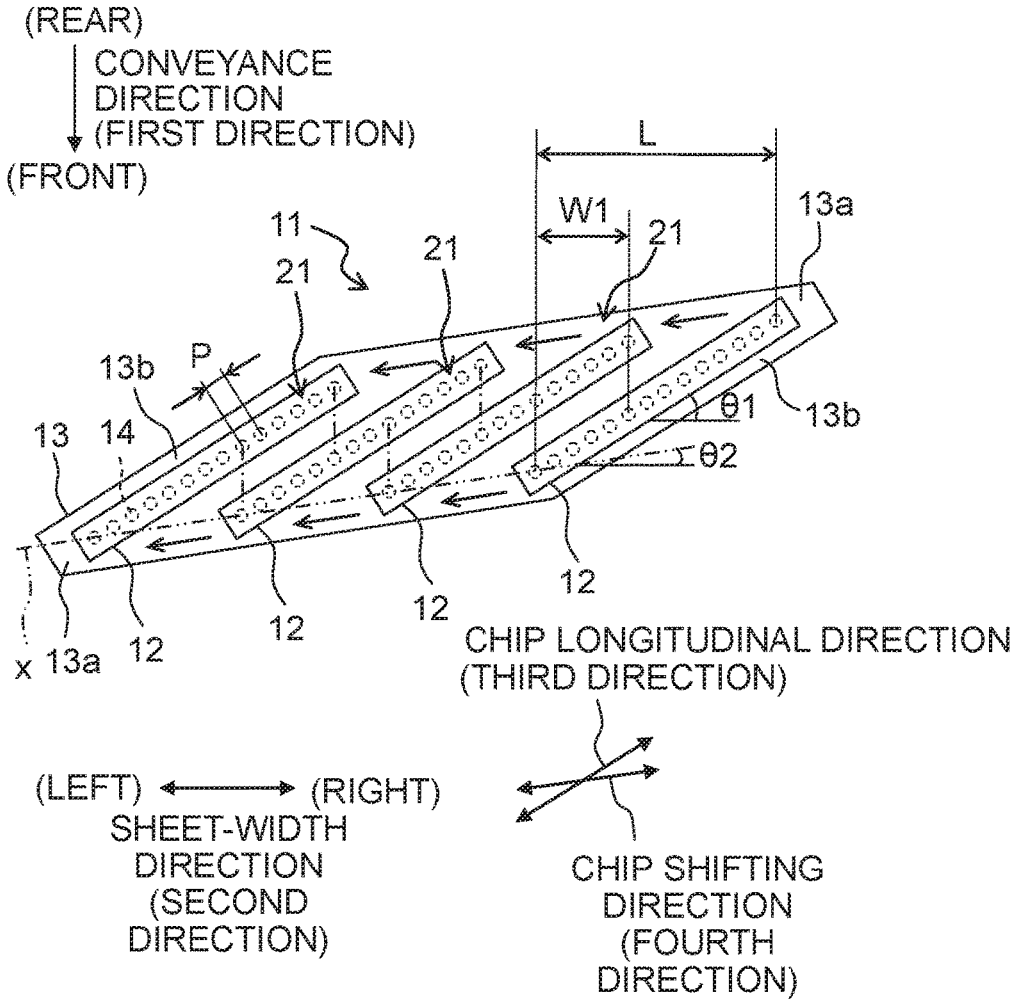
FIG. 3 is a top view of a head unit.

As depicted in FIG. 3, each of the head units 11 (hereinafter referred to as "one head unit 11", as appropriate) is provided with four nozzle chips 12, and a holder 13 configured to hold the four nozzle chips 12.

Each of the nozzle chips 12 extends in an oblique direction (hereinafter referred to also as a chip longitudinal direction) crossing each of the front/rear direction and the left/right direction. Further, the lower surface (a surface on the far side of the sheet surface of FIG. 3) of each of the nozzle chips 12 is formed with a plurality of nozzles 14 which are aligned in the chip longitudinal direction at a predetermined spacing distance P. The four nozzle chips 12 have a same length, and arrangement areas, of each of the four nozzle chips 4, in each of which the nozzles 14 are arranged also have a same length among the four nozzle chips 12. A same color ink is supplied from a common ink tank (not depicted in the drawings) to the four nozzle chips 12, and further, the plurality of nozzles 14 in each of the nozzle chips 12 jet the same color ink.

Each of the nozzle chips 12 is arranged to be shifted relative to another nozzle chip 12 different therefrom and included in the four nozzle chips 12, in a direction (hereinafter referred to as a "chip shifting direction") which crosses both of the front/rear direction and the left/right direction and which is different from the chip longitudinal direction. More specifically, the respective four nozzle chips 12 are arranged along the chip shifting direction, and a spacing distance, between each nozzle chip 12 relative to another adjacent nozzle chip 12 included in the four nozzle chips 12 and adjacent thereto, is all same among the four nozzle chips 12. Note that the phrase the "spacing distance . . . is all same among the four nozzle chips 12" is assumed to encompass also such a case that any slight shifting is present due to any manufacturing error and/or any assembling error. Further, the description such as "coincident" or "same, equal", etc. regarding the layout of the nozzle chips 12 and/or the positional relationship among the nozzles 14, etc., to be described in the following are similarly assumed to encompass also such a case that any slight shifting is present due to any manufacturing error and/or any assembling error. Namely, the four nozzle chips 12 are arranged on a straight line X extending in the chip shifting direction, with equal spacing distances therebetween.

The holder 13 is configured to hold the four nozzle chips 12 which are arranged at the oblique posture, as described above, and has a planar shape which is substantially parallelogrammatic. Further, in accordance with the arrangement wherein the four nozzle chips 12 are shifted in the chip shifting direction, the holder 13 having the parallelogrammatic shape is also arranged at a posture such that the long sides thereof are along the chip shifting direction. Note that if two corner portions 13*a* in a direction of the long diagonal line of the holder 13 were each allowed to extend to be long, the sizes in the front/rear direction and the left/right direction of the head unit 11, and consequently the size of the ink-jet head 4, would become great. In view of this, the holder 13 has such a shape that tip ends of the corner portions 13*a* are cut off (chamfered).

As depicted in FIGS. 2 and 3, in one head unit 11, end portions of two adjacent nozzle chips 12, among the four nozzle chips 12, overlap with each other in the front/rear direction. Namely, the two adjacent nozzle chips 12 are arranged such that the respective arrangement areas of the nozzles 14 partially overlap with each other. In the following, a portion which is located between two adjacent nozzle chips 12 in one head unit 11 and in which the arrangement areas of the nozzles 14 of the two adjacent nozzle chips 12 overlap with each other is referred to as a first overlapping portion 21; and the length in the left/right direction of the first overlapping portion 21 is referred to as an overlapping width W1. In this first overlapping area 21, the positions in the left/right direction of the nozzles 14 of the two nozzle chips 12 are coincident. Further, with respect to the four nozzle chips 12, all the overlapping widths W1 of three first overlapping portions 21 existing among the four nozzle chips 12 are same with one another.

Note that as depicted in FIG. 2, the four head units 11 all have a same structure (configuration), and the shape, size, layout, etc. of the nozzle chips 12 are all same among the four head units 11. For example, the respective positions in the conveyance direction of the four nozzle chips 12 are coincident among the four head units 11. Further, the length of the nozzle chips 12 is same among the four head units 11, and the length of the arrangement area of the nozzles 14 is also same among the four head units 11.

As depicted in FIG. 2, end portions of two nozzle chips 12 partially overlap with each other also between two head units 11 which are adjacent in the left/right direction. Namely, a nozzle chip 12 located on the right end of a left head unit 11 and a nozzle chip 12 located on the left end of a right head unit 11 are arranged such that the respective arrangement areas of the nozzles 14 partially overlap with each other in the front/rear direction. In the following, a portion which is located between two nozzle chips 12 belonging respectively to two adjacent head units 11 and in which arrangement areas of the nozzles 14 overlap with each other is referred to as a second overlapping portion 22; and the length in the left/right direction of the second overlapping portion 22 is referred to as an overlapping width W2. Also in this second overlapping area 22, the positions in the left/right direction of the nozzles 14 of the two nozzle chips 12 are coincident. Further, with respect to the four head units 11, the overlapping width W2 is same in all three second overlapping portions 22 existing among the four head units 11.

Note that in the present embodiment, the overlapping width W1 of the first overlapping portion 21 and the overlapping width W2 of the second overlapping portion 22 are same. Namely, the number of the nozzles 14 overlapping in the first overlapping portion 21 and the number of the nozzles 14 overlapping in the second overlapping portion 22 are same. In a case that the overlapping widths W1 and W2 are same, there is no need to perform different controls respectively for the jetting control in the first overlapping portion 21 within one head unit 11 and the jetting control in the second overlapping portion 22 between two head units 22, thereby making it possible to easily perform the processing for the jetting control.

Note that, as will be explained later on, in the overlapping portions 21 and 22, the ink is jetted from each of the two head units 11 so as to make any unevenness in the density to be less conspicuous. In this situation, if the overlapping widths W1 and W2 of the overlapping portions 21 and 22 are too small, the gradient of the usage ratio (see FIG. 4) becomes so steep that the unevenness in the density becomes conspicuous. On the other hand, if the overlapping widths W1 and W2 are too large, the number of the nozzles 14 required for performing printing on a region of a predetermined width becomes too many Further, since each of the nozzle chips 12 has a width to certain extent in the short direction thereof (hereinafter referred to also as a chip short direction) and the nozzles 14 are apart between the two nozzle chips 12 by a distance at least corresponding to the width in the chip short direction of each of the nozzle chips 12, there is a limit in increasing the overlapping widths W1 and W2. From the above-described viewpoints, the first overlapping width W1 of the first overlapping portion 21 and the second overlapping width W2 of the second overlapping portion 22 are each preferably not less than 10% of the length in the left/right direction of the arrangement area of the nozzles 14 of each of the nozzle chips 12(hereinafter referred also to as "one nozzle chip 12", as appropriate). In a case that the number of nozzles 14 aligned in one nozzle chip 12 is 400 pieces, the number of the nozzles 14 in each of the overlapping widths W1 and W2 is preferably not less than 40 pieces.

<Jetting Control in Overlapping Portion>

By the way, due to any deviation in the positions of the nozzle chips 12 caused by any assembling error, and/or due to any difference in the jetting characteristic of the nozzles 14 between the two adjacent nozzle chips 12, the landing positions of ink (droplets of the ink) jetted respectively from the nozzles 14 of two adjacent head units 11 are deviated between the two adjacent head units 11, in some cases. Due to such a deviation in the landing positions, any unevenness in the density easily occurs at a portion of an image formed by the joint or knot between the two nozzle chips 12. In view of such a situation, in the present embodiment, the controller 7 performs such a control so as to cause the ink to be jetted from both of the two nozzle chips 12 in each of the overlapping portions 21 and 22 in which the arrangement areas of the nozzles 14 overlap with each other between the two nozzle chips 12.

Figure 4:
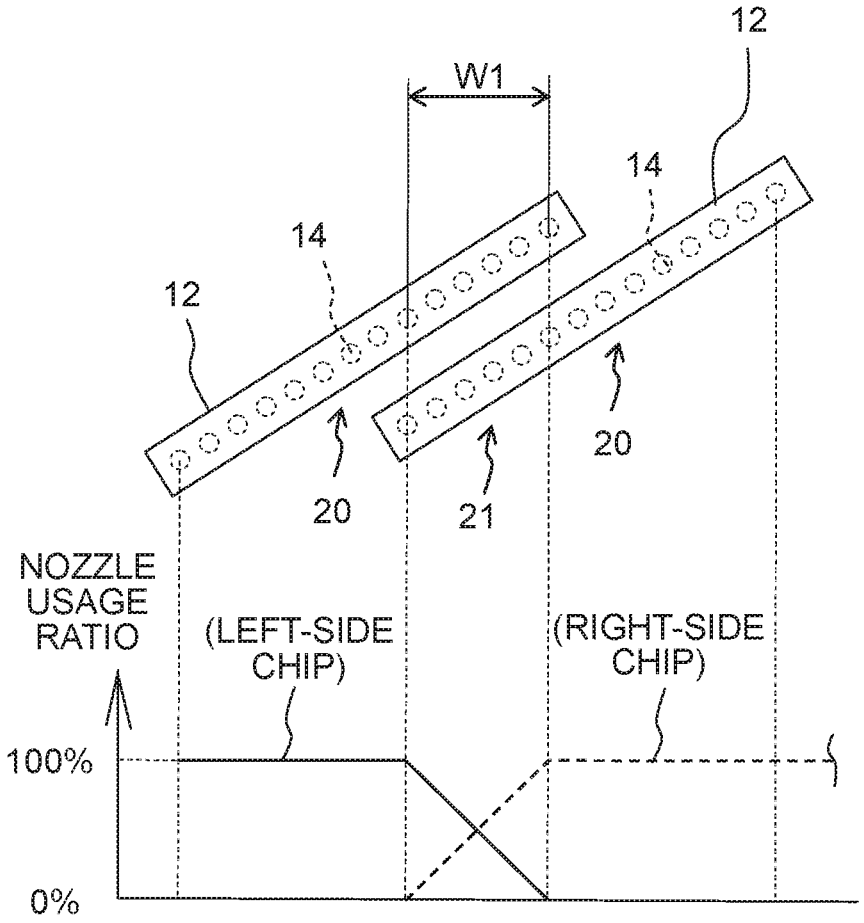
FIG. 4 is a view explaining jetting control in a first overlapping portion between two nozzle chips.

An explanation will be given about the jetting control in the overlapping portions 21 and 22, with reference to FIG. 4. Note that since there is no substantial difference in the content of the jetting control between the first overlapping portion 21 within one head unit 11 and the second overlapping portion 22 between two head units 11, FIG. 4 depicts the control in the first overlapping portion 21, by way of example.

In the overlapping portion 21 (22), the controller 7 causes the ink to be jetted from both of the nozzles 14 of a nozzle chip 12 on the left side and the nozzles 14 of another nozzle chip 12 on the right side, at a predetermined nozzle usage ratio. A lower portion of the drawing of FIG. 4 indicates the change in the usage ratio of the nozzles 14 between the left-side nozzle chip 12 and the right-side nozzle chip 12. In a non-overlapping portion 20, of each of the left-side nozzle chip 12 and the right-side nozzle chip 12, in which the nozzles 14 are not overlapped between the left-side nozzle chip 12 and the right-side nozzle chip 12, only the nozzles 14 in the non-overlapping portion 20 are used; thus, the nozzle usage ratio is 100%. In the overlapping portion 21 (22), the nozzle usage ratio is linearly changed. Namely, the nozzle usage ratio of the left-side nozzle chip 12 is continuously decreased from the left side to the right side of the drawing.

The term "nozzle usage ratio" is a ratio of dots, to be formed in a predetermined region of the recording sheet 100, by using the nozzles 14 belonging to one of the two nozzle chips 12 in which proportion. For example, in a case that ten (10) dots are needed to be formed in one region based on a density data of each of the respective inks obtained by subjecting an RGB image data to an image processing, provided that the nozzle usage ratio of the left-side nozzle chip 12 in this region is 70%. In such a case, consequently, 7 dots among the 10 dots within the region are formed by using the nozzles 14 of the left-side nozzle chip 12, and remaining 3 dots among the 10 dots are formed by using the nozzles 14 of the right-side nozzle chip 12.

In the first and second overlapping portions 21 and 22, by jetting the ink from each of the two nozzle chips 12 in such a manner, it is possible make any unevenness in the density, which is caused due to the deviation in the landing positions of the ink between two nozzle chips 12, to be less conspicuous.

Note that in the overlapping portion 21 (22), the nozzles 14 of the two nozzle chips 12 are apart in the front/rear direction, and thus the inks jetted from the two nozzle chips 12 respectively land on the predetermined region at a time interval. Here, it is generally known that, as the time interval between the landing timings of the inks jetted respectively from two nozzles 14 is greater, the density of the image becomes higher. Accordingly, a portion of the image formed by using the nozzles 14 of the overlapping portion 21 (22) tends to have a higher density as compared with another portion of the image formed by using only the nozzles 14 of a single nozzle chip 12 (by using only the nozzles of the non-overlapping portion 20). In view of this, the controller 7 makes the amount of the ink, which is to be jetted per unit area of the recording sheet 100, to be smaller in each of the first and second overlapping portions 21 and 22, than that in the non-overlapping portion 20.

Further, as depicted in FIG. 2, a spacing distance L2 in the front/rear direction between the two nozzle chips 12 in the second overlapping portion 22 is greater than a spacing distance L1 in the front/rear direction between the two nozzle chips 12 in the first overlapping portion 21. Namely, in the second overlapping portion 22, the time interval between the landing timings of inks jetted respectively from the nozzles 14 of two nozzle chips 12 is great. Accordingly, a portion of the image formed by the second overlapping portion 22 tends to be denser than another portion of the image formed by the first overlapping portion 21. In view of this, the controller 7 further makes the amount of the ink to be jetted per unit area of the recording sheet 100 in the second overlapping portion 22 to be smaller than that in the first overlapping area 21.

In the foregoing explanation, the phrase "makes (making) the amount of the ink, which is to be jetted . . . , to be small in the overlapping portion 21 (22)" means increasing the extent to which the jet amount of the ink is decreased with respect to a reference jet amount of the ink which is determined by an image data. In other words, provided that the reference jet amount of the ink, which is determined by the image data, is same in two image forming regions as the targets for comparison, the jet amount to one of the regions is made to be smaller than that to the other one of the regions.

Figure 5:
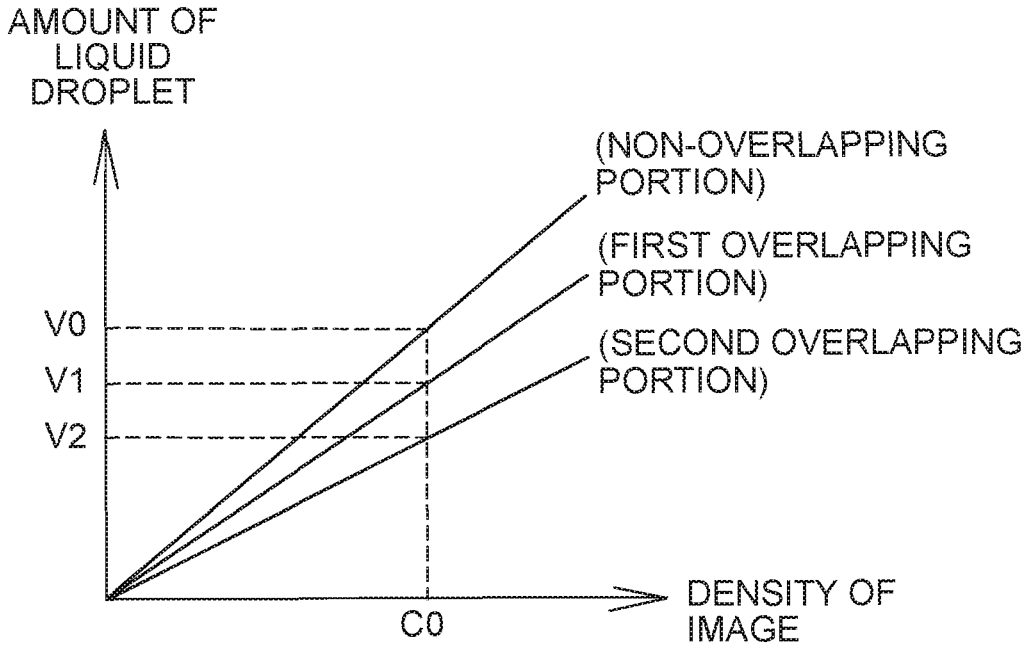
FIG. 5 is a graph indicating the relationship between density and liquid droplet amount regarding a non-overlapping portion, the first overlapping portion, and a second overlapping portion.

The above-described content of the jetting control will be specifically explained with reference to FIG. 5. Provided that an image of a predetermined density C0 is to be formed on the recording sheet 100 by each of the non-overlapping portion 20, the first overlapping portion 21 and the second overlapping portion 22. In this case, provided that a liquid droplet amount from each of the nozzles 14 in the non-overlapping portion 20 is "V0", a liquid droplet amount from each of the nozzles 14 in the first overlapping portion 21 is "V1", and a liquid droplet amount from each of the nozzles 14 in the non-overlapping portion 20 is "V2", then V0>V1>V2 holds, as depicted in FIG. 5. For example, there is assumed such a case that the liquid droplet amount V0 in the non-overlapping portion 20=15 pl, the liquid droplet amount V1 in the first overlapping portion 21=12 pl, and the liquid droplet amount V2 in the second overlapping portion 22=10 pl.

Note that in performing the above-described jetting control in the overlapping portion 21 (22), as the overlapping width W1 (W2) is greater, the ink can be landed in a dispersed manner in a wider region. Accordingly, any unevenness in density of an image formed by the overlapping portion 21 (22) can be made to be less conspicuous. Note that even in a case that the unevenness in density is present in an image formed by each of the nozzle chips 12, the unevenness in density can be made to be less conspicuous by making the overlapping width W1 of the overlapping portion 21 to be greater.

Firstly, the overlapping width W1 in the first overlapping portion 21 within one head unit 11 is greatly influenced by the posture of the nozzle chips 12. Namely, as depicted in FIG. 3, provided that the inclination angle in the chip longitudinal direction of the nozzle chip 12 with respect to the left/right direction is θ1, as the inclination angle θ1 is smaller, namely as the nozzle chip 12 assumes a more laterally oriented posture, the overlapping width W1 of the first overlapping portion 21 between two adjacent nozzle chips 12 becomes greater. Namely, in order to increase the overlapping width W1 of the first overlapping portion 21, the inclination angle θ1 is preferably made to be small, specifically, preferably made to be an angle within a range of 0 degrees<θ1<45 degrees. For example, in the present embodiment, θ1=30 degrees.

On the other hand1, in order to increase the overlapping width W2 of the second overlapping portion 22, it is effective to decrease the distance between two adjacent head units 11 as small as possible, as understood from FIG. 2. Note that, however, in view of assembling the respective head units 11 into the holding plate 10, there is a limit in decreasing the distance between the adjacent head units 11 to be small. Further, in a case that edge portions 13*b* of the holder 13 are present respectively on the left and right sides, at a location on the outside of the four nozzle chips 12 as depicted in FIG. 3, the distance between the nozzle chips 12 between the two head units 11 becomes great by an extent corresponding to the edge portions 13*b*.

In view of this, in the present embodiment, each of the nozzle chips 12, of each of the head units 11, is arranged to be shifted with respect to another nozzle chip 12 different therefrom in a chip shifting direction which crosses both of the front/rear direction and the left/right direction and which is different from the chip longitudinal direction. With this, within one head unit 11, a right-end nozzle chip 12 and a left-end nozzle chip 12 are shifted from each other in the front/rear direction. With this, it is possible to arrange, between two head units 11 which are adjacent in the left/right direction, a nozzle chip 12 located on the right end in the left head unit 11 and a nozzle chip 12 located on the left end in the right head unit 11 closely to each other in the left/right direction, as depicted in FIG. 2. Accordingly, it is possible to make the overlapping width W2 of the second overlapping portion 22 between the two head units 11 to be greater. For example, it is possible to make the overlapping width W2 to be not less than 10% of a length L (see FIG. 3) in the left/right direction of the arrangement area of the nozzles 14.

Note that in FIG. 3, provided that an inclination angle, of the chip shifting direction of the nozzle chip 12, relative to the left/right direction is an angle θ2, the shifting amount between the adjacent nozzle chips 12 becomes greater as the angle θ2 is greater. With this, it is possible to arrange the two nozzle chips 12 further closely to each other, between the adjacent two head units 11, thereby making it possible to increase the overlapping width W2 of the second overlapping portion 22. Note that if the angle θ2 becomes greater than the angle θ1, of the chip longitudinal direction, relative to the left/right direction, the adjacent nozzle chips 12 interfere with each other. Accordingly, the angle θ2 should be always smaller than the angle θ1. Namely, in view of increasing the overlapping width W2 of the second overlapping portion 22, the angle θ2 is preferably to be great as much as possible within a range of angle that is smaller than the angle θ1.

By the above-described configuration, the present embodiment is capable of realizing a configuration wherein the overlapping width W1 of the first overlapping portion 21 is same as the overlapping width W2 of the second overlapping portion 22. In this configuration, it is possible to suppress any unevenness in the density occurring at the joint between the two adjacent head units 11, to an extent same as the suppression of the unevenness in the density occurring at the joint between the two nozzle chips 12 within one head unit 11.

In one head unit 11, the four nozzle chips 12 are arranged side by side in the predetermined chip shifting direction; and the spacing distance in the chip shifting direction, between each of the four nozzle chips 12 relative to another adjacent nozzle chip 12 included in the four nozzle chips 12 and different therefrom and adjacent thereto, is all same among the four nozzle chips 12. With this, each of the shift direction and the shift amount between the nozzle chips 12 is same regarding the four nozzle chips 12 within one head unit 11, which in turn makes the overlapping widths W1 in the three locations within one head unit 11 to be same. In this configuration, it is possible to suppress any unevenness in the density in a part of the first overlapping portions 21 from becoming locally conspicuous.

The positons in the conveyance direction of the respective four nozzle chips 12 are coincident among the four head units 11. In this configuration, it is possible to suppress the size in the conveyance direction of the ink-jet head 4 to be small. Further, the lengths of the arrangement areas of the nozzles 14 of the four nozzle chips 12 are same among all of the four head units 11, as well. With this, the overlapping width W1 of the first overlapping portion 21 can be easily made same regarding the four nozzle chips 12 within one head unit 11. Further, by allowing all of the head units 11 to have the same configuration, the head unit 11 can be usable for another ink-jet head of which number of the head unit 11 is different from that of the ink-jet head 4, which in turn increases the versatility of the head unit 11.

The overlapping widths W2 of the three second overlapping portions 22 are made to be same regarding all the four head units 11. In this configuration, it is possible to suppress any unevenness in the density in a part of the second overlapping portions 22 from becoming locally conspicuous.

In the embodiment as described above, the ink-jet head 4 corresponds to the "liquid jetting apparatus" of the present teaching. The conveyance direction corresponds to the "first direction" of the present teaching, and the sheet-width direction corresponds to the "second direction" of the present teaching. The chip longitudinal direction corresponds to the "third direction" of the present teaching, and the chip shifting direction corresponds to the "fourth direction" of the present teaching.

Next, an explanation will be given about modifications in which various changes are made to the above-described embodiment. Note that, however, any parts or components constructed in the similar manner to those in the above-described embodiment are designated with same reference numerals, and description thereof is omitted as appropriate.

Modification 1

In the above-described embodiment, the overlapping width W2 of the second overlapping portion 22 is made to be same as the overlapping width W1 of the first overlapping portion 21. It is allowable, however, that the overlapping width W2 may be greater or smaller than the overlapping width W1. Further, in the above-described embodiment, although the overlapping widths W2 are same in all the three second overlapping portions 11 regarding the four head units 4, it is allowable that the overlapping width W2 of the three overlapping portions 22 may be different from one another regarding the four head units 4. In such a case, in two head units 11 which are adjacent in the left/right direction, the overlapping widths W2 of the second overlapping portions 22 may be determined, respectively, depending on the jetting characteristic of a rightmost nozzle chip 12 included in a left-side head unit 11 among the two adjacent head units 11 and the jetting characteristic of a leftmost nozzle chip 12 included in a right-side head unit 11 among the two adjacent head units 11. Note that, however, in view of suppressing any unevenness in the density in an entire image which is formed on the recording sheet 100, it is most preferred that the overlapping width W2 is same as the overlapping width W1, as in the above-described embodiment.

Modification 2

In the above-described embodiment, there is provided such an aspect that the inclination (angle θ1) of the nozzle chip 12 relative to the left/right direction is made to be relatively small, in view of increasing the overlapping width W1 of the first overlapping portion 21 between the two nozzle chips 12. With respect to this configuration, it is also possible to increase the inclination of the nozzle chip 12 so as to decrease the arrangement interval (spacing distance) between the nozzles 14 in the left/right direction, for the purpose of realizing an ink-jet head capable of performing high-resolution printing.

Figure 6:
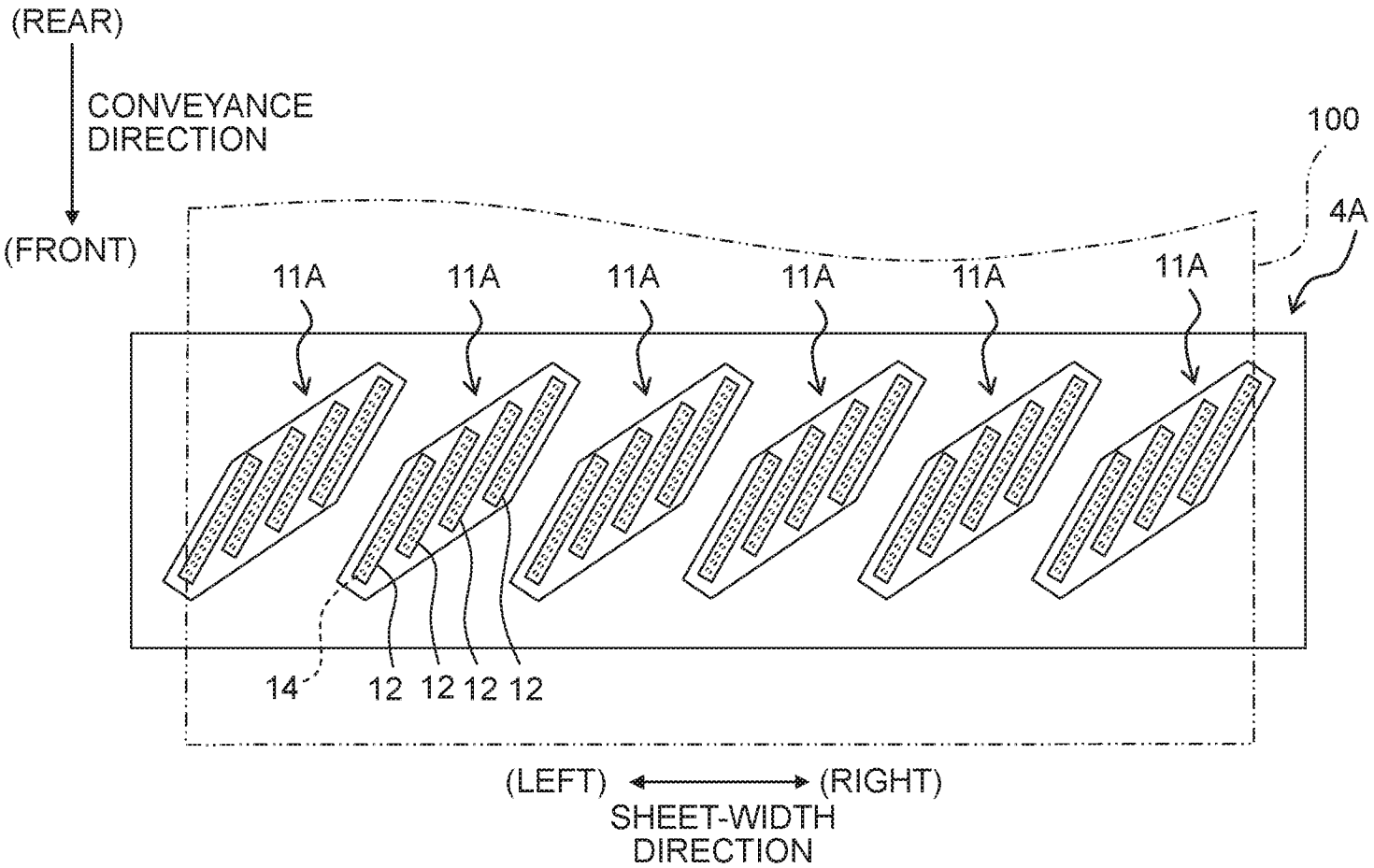
FIG. 6 is a top view of an ink-jet head of modification 2.
Figure 7:
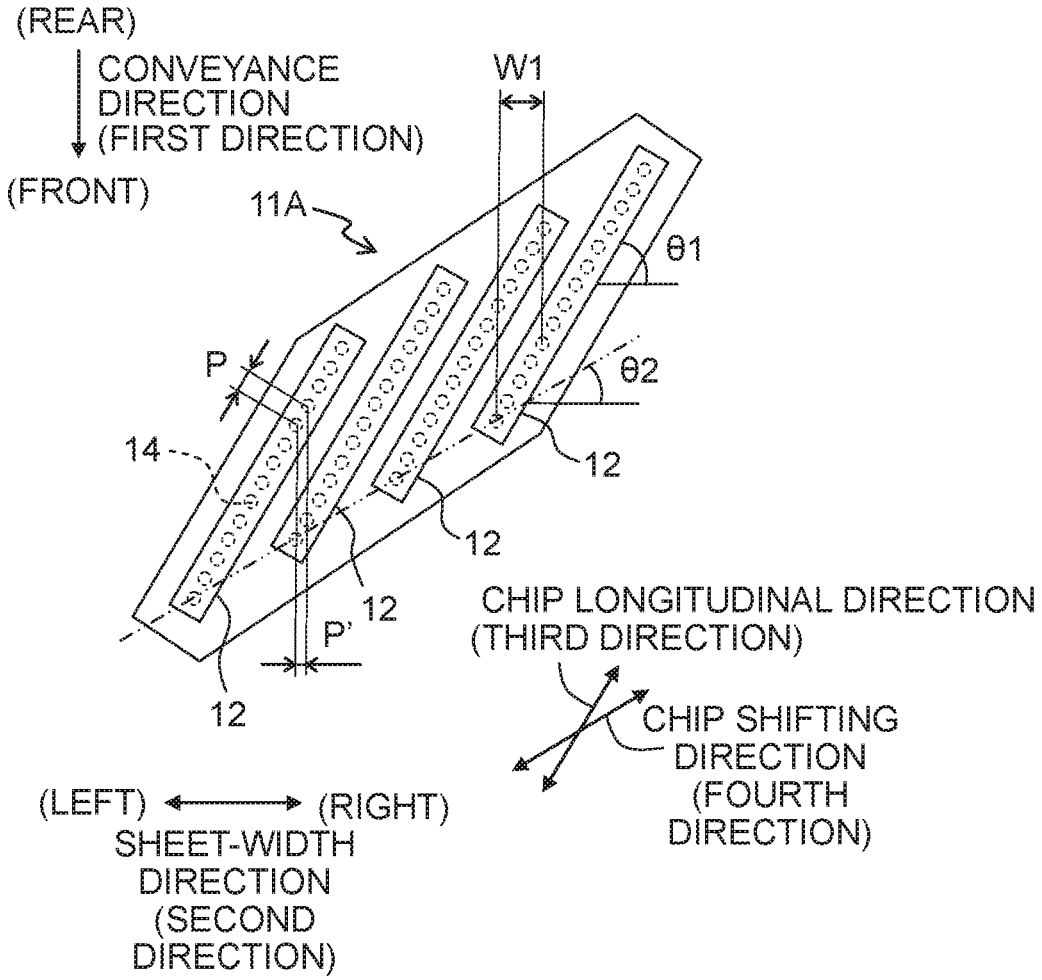
FIG. 7 is a top view of a head unit of FIG. 6.

From the foregoing viewpoint, as in an ink-jet head 4A of FIG. 6 and a head unit 11A of FIG. 7, the inclination angle θ1 of each of the nozzle chips 12 may be made great. Specifically, the inclination angle θ1 may be in a range of 45 degrees≤θ1<90 degrees. As depicted in FIG. 7, in a case that the arrangement interval between the nozzles 14 in the chip longitudinal direction is "P", then the arrangement interval between the nozzles 14 in the left/right direction is P'=P cos θ1. As the angle θ1 is greater, the arrangement interval P' becomes smaller; for example, in a case that 01=60 degrees, then P'=P/2 holds. In FIG. 6, the arrangement interval P' between the nozzles 14 in the left/right direction can be made small as compared with the configuration of the embodiment as depicted in FIG. 2, it is possible to arrange 6 pieces of the head unit 11A side by side in the left/right direction with respect to the width, of the recording sheet 100, that is same as that in the embodiment.

Note that in order to increase the overlapping width W1 of the first overlapping portion 21 within one head unit 11A in a case that the angle θ1 is made to be great as in FIG. 7, it is preferred that the angle θ2 is small, namely that the shifting between the nozzle chips 12 is small. From this viewpoint, it is preferred that the inclination angle θ2 is in a range of 0 degrees<θ2≤45 degrees.

Figure 8:
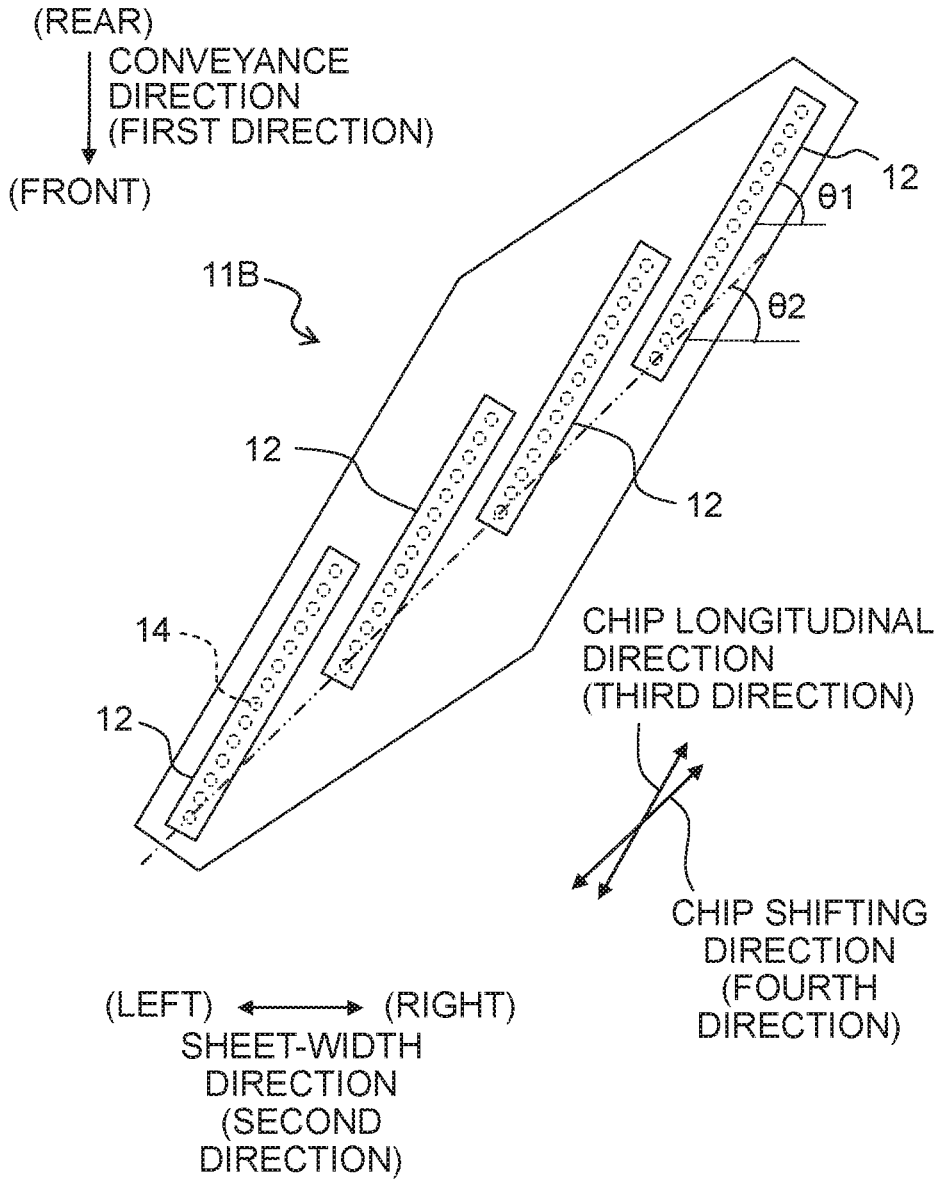
FIG. 8 is a top view depicting modification of the head unit of FIG. 7.

On the other hand, it is allowable that the inclination angle θ2 is in a range of 45 degrees<θ2<90 degrees. By increasing the angle θ2 as in a head unit 11B of FIG. 8, a right-end nozzle chip 12 and a left-end nozzle chip 12 are shifted from each other greatly in the front/rear direction. With this, the overlapping width between the nozzle chips 12 belonging to the two head units 11B, respectively, can be made great.

Modification 3

The arrangement of the plurality of nozzle chips 12 within one head unit is not limited to the configuration of the above-described embodiment. In order to increase the overlapping width of the nozzle chips 12 between the two head units, it is sufficient that at least the right-end nozzle chip 12 and the left-end nozzle chip 12 are arranged such that the positions in the chip shifting direction thereof are shifted from each other, and that the remaining configuration other than this can be appropriately changed.

Figure 9:
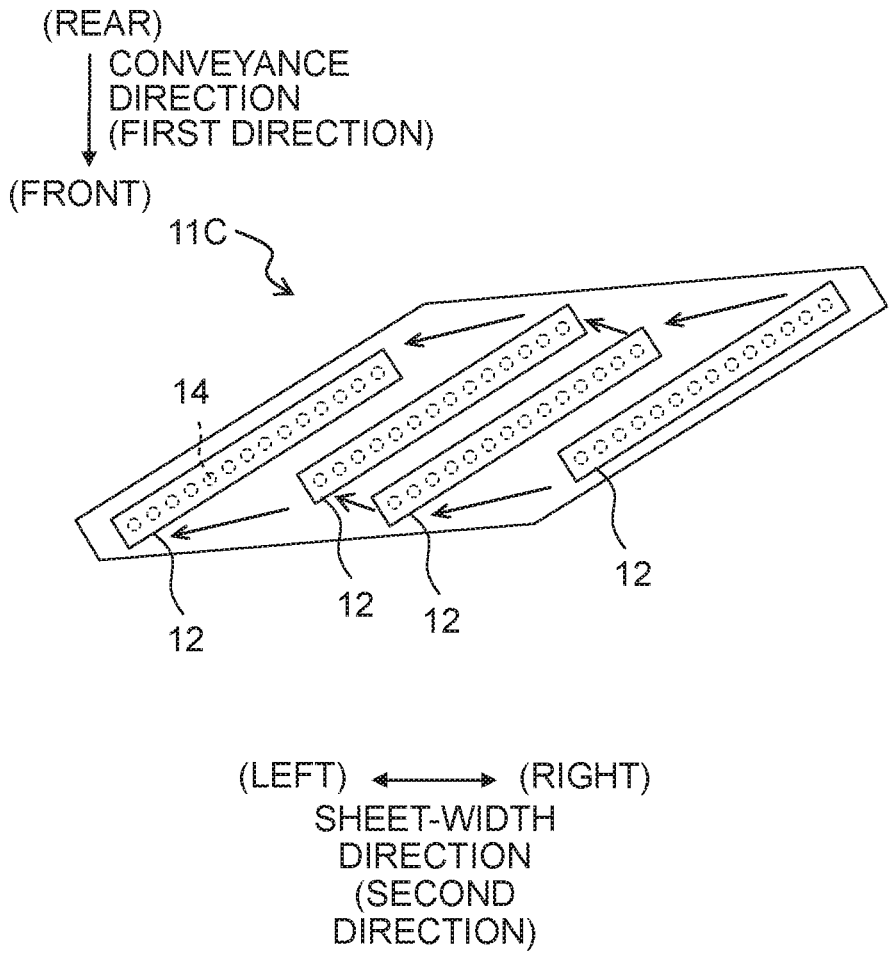
FIG. 9 is a top view of a head unit of modification 3.
Figure 10A:
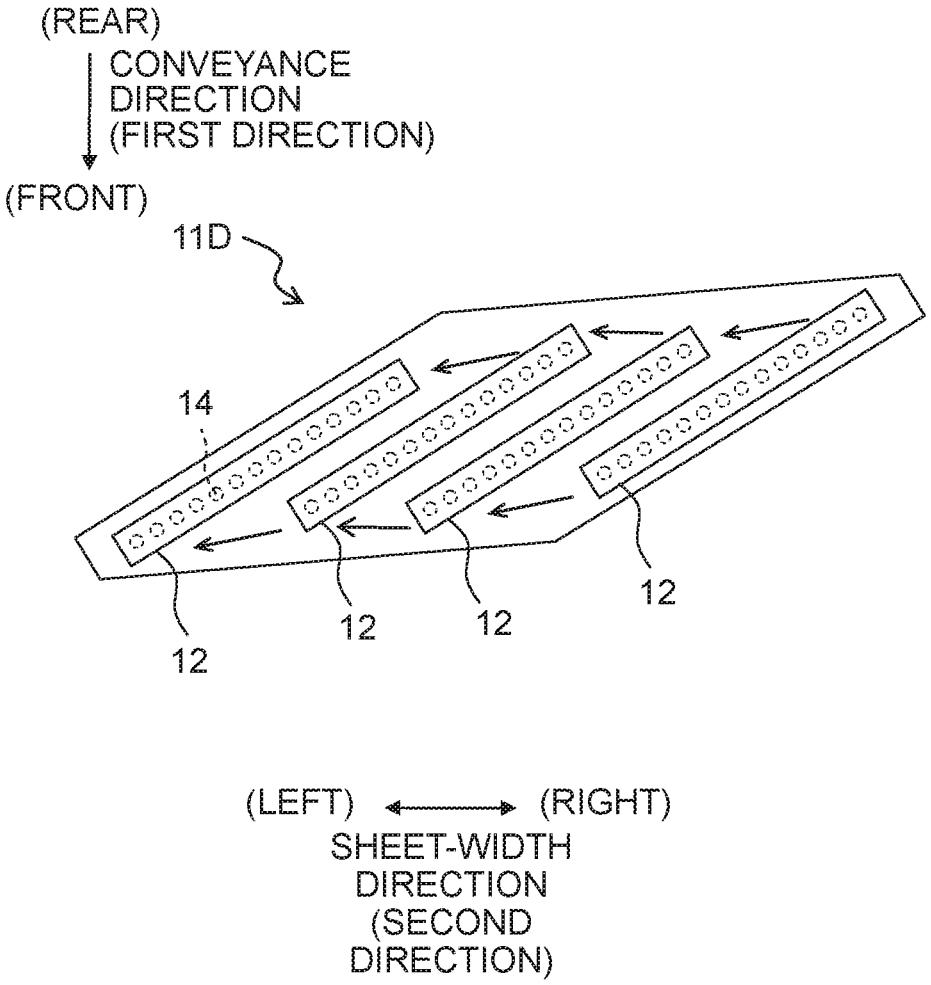
FIGS. 10A to 10C are each a top view depicting modification of the head unit of FIG. 9.
Figure 10B:
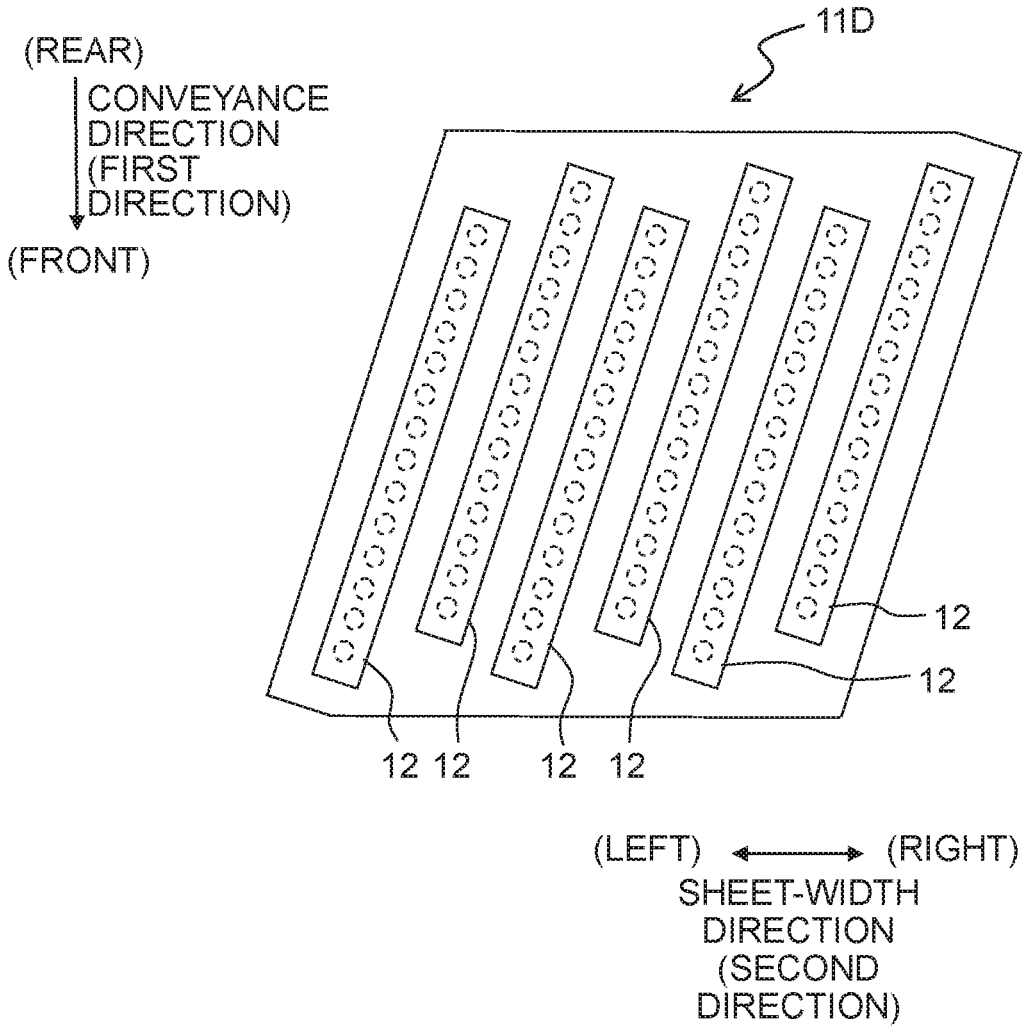
Figure 10C:
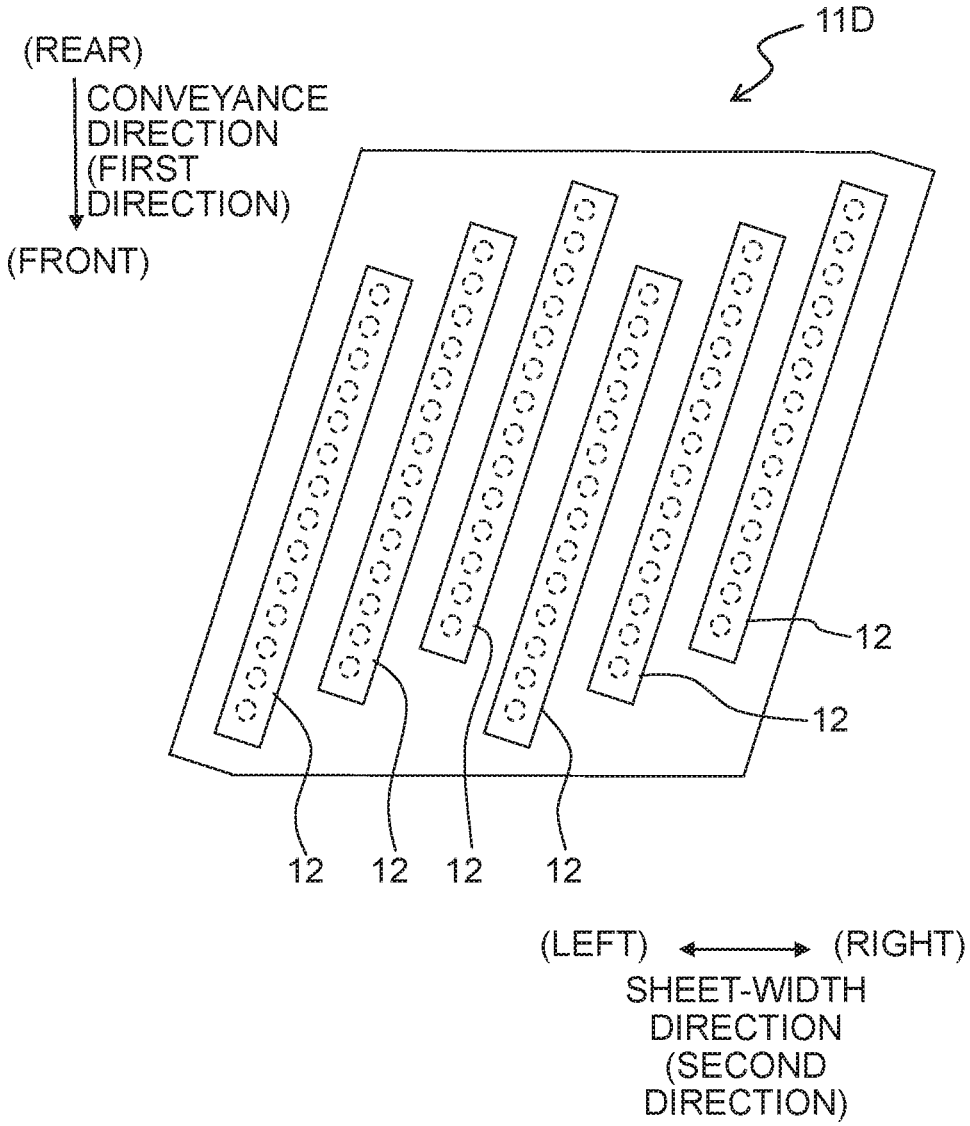

For example, as in a head unit 11C of FIG. 9, it is allowable that the shifting direction is changed halfway among the four nozzle chips 12, rather than shifting all of the four nozzle chips 12 in order (one by one) in a predetermined one direction. Alternatively, as in a head unit 11D of FIG. 10A, is it allowable to provide such a configuration wherein central two nozzle chips 12 which are located at a central portion among the four nozzle chips 12 are arranged such that the positions thereof are shifted from each other only in the left/right direction, but not in the front/rear direction. Alternatively, as depicted in FIG. 10B, in a case that six nozzle chips 12 are included in each of head units 11D (one head unit 11D), it is allowable to provide such a configuration that first, third and fifth nozzle chips 12 from the left are shifted from one another only in the left/right direction; that second, fourth and sixth nozzle chips 12 from the left are also shifted from one another only in the left/right direction; and that the first, third and fifth nozzle chips 12 from the left are shifted from the second, fourth and sixth nozzle chips 12 from the left in the front/rear direction. Still alternatively, as depicted in FIG. 10C, it is allowable to provide such a configuration that first and fourth nozzle chips 12 from the left are shifted from each other only in the left/right direction; second and fifth nozzle chips 12 from the left are also shifted from each other only in the left/right direction; third and sixth nozzle chips 12 from the left are also shifted from each other only in the left/right direction; and that the first and fourth nozzle chips 12 from the left, the second and fifth nozzle chips 12 from the left and the third and sixth nozzle chips 12 from the left are shifted from one another in the front/rear direction.

Modification 4

Figure 11:
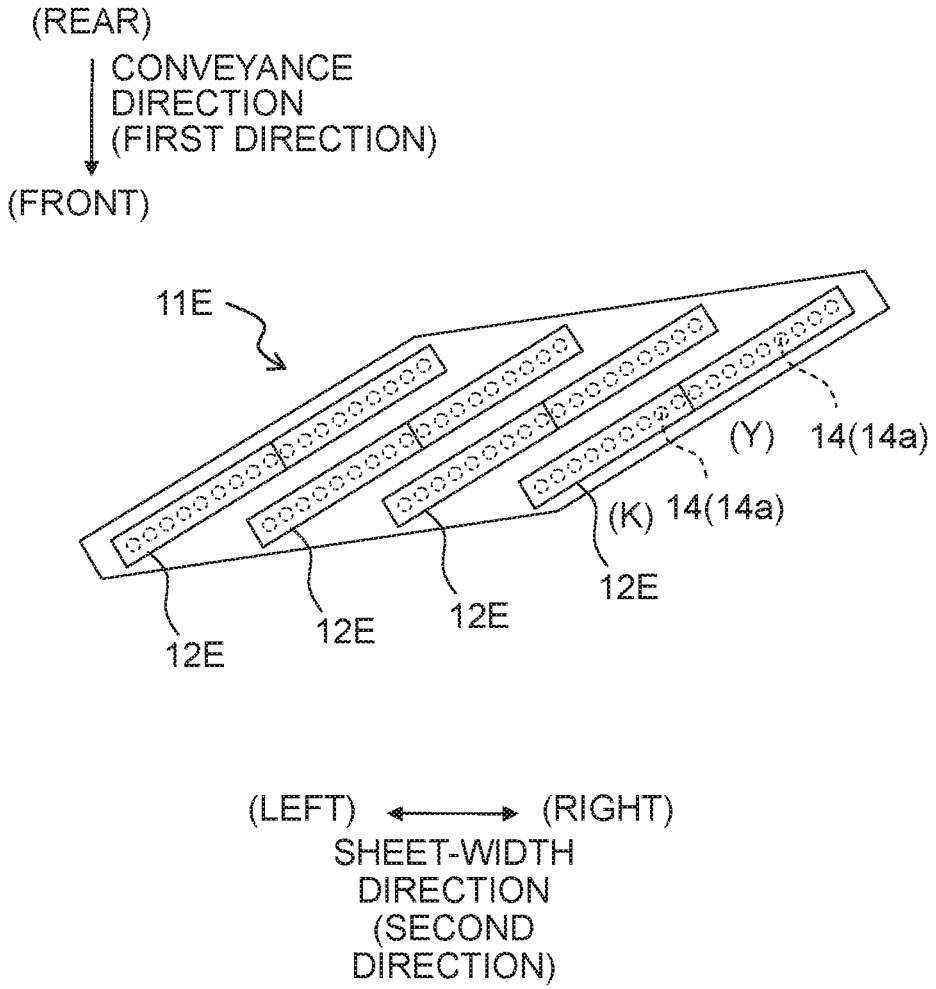
FIG. 11 is a top view of a head unit of modification 4.

The above-described embodiment has the configuration wherein one nozzle chip 12 jets a same color ink from the plurality of nozzles 14. It is allowable, however, to provide such a configuration wherein one nozzle chip 12 jets two or more colors inks. For example, a head unit 11E of FIG. 11 is configured such that nozzles 14*a*, which are included in a plurality of nozzles 14 constructing each of nozzle chips 12E and which are located on the front side, are nozzles 14 configured to jet a black ink (K), and nozzles 14*b* located on the rear side are nozzles 14 configured to jet a yellow ink (Y). In this case, the length of a nozzle row jetting a same (one) color ink is half that of the above-described embodiment, and thus unless the distance between two pieces of the nozzle chip 12E is considerably short, it is not possible, in two pieces of the nozzle chip 12E, to overlap the nozzles 14 jetting the same color ink. In other words, particularly in a case of using the nozzle chips 12E each of which is configured to jet two or more color inks as depicted in FIG. 11, the present teaching is suitably applicable for the purpose of increasing the overlapping width of the nozzle chips 12E between two adjacent head units 11E.

Figure 12:
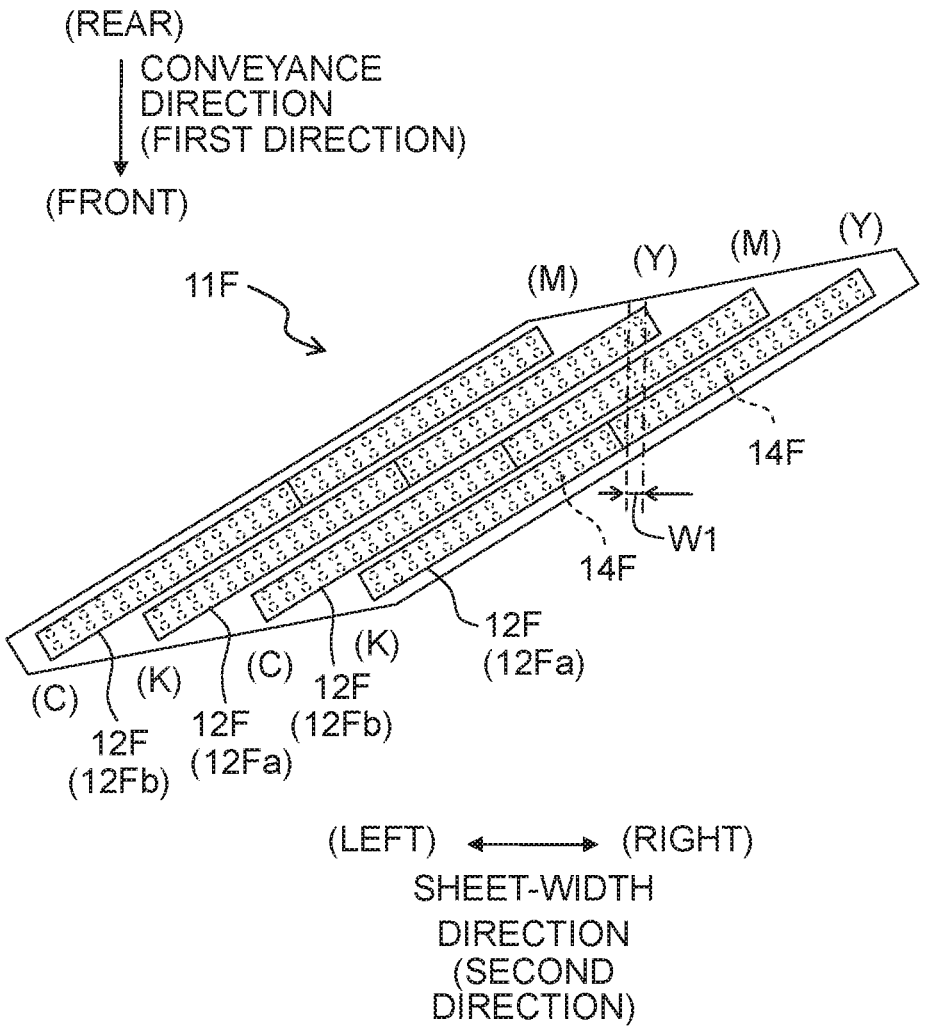
FIG. 12 is a top view depicting modification of the head unit of FIG. 11.
Figure 13:
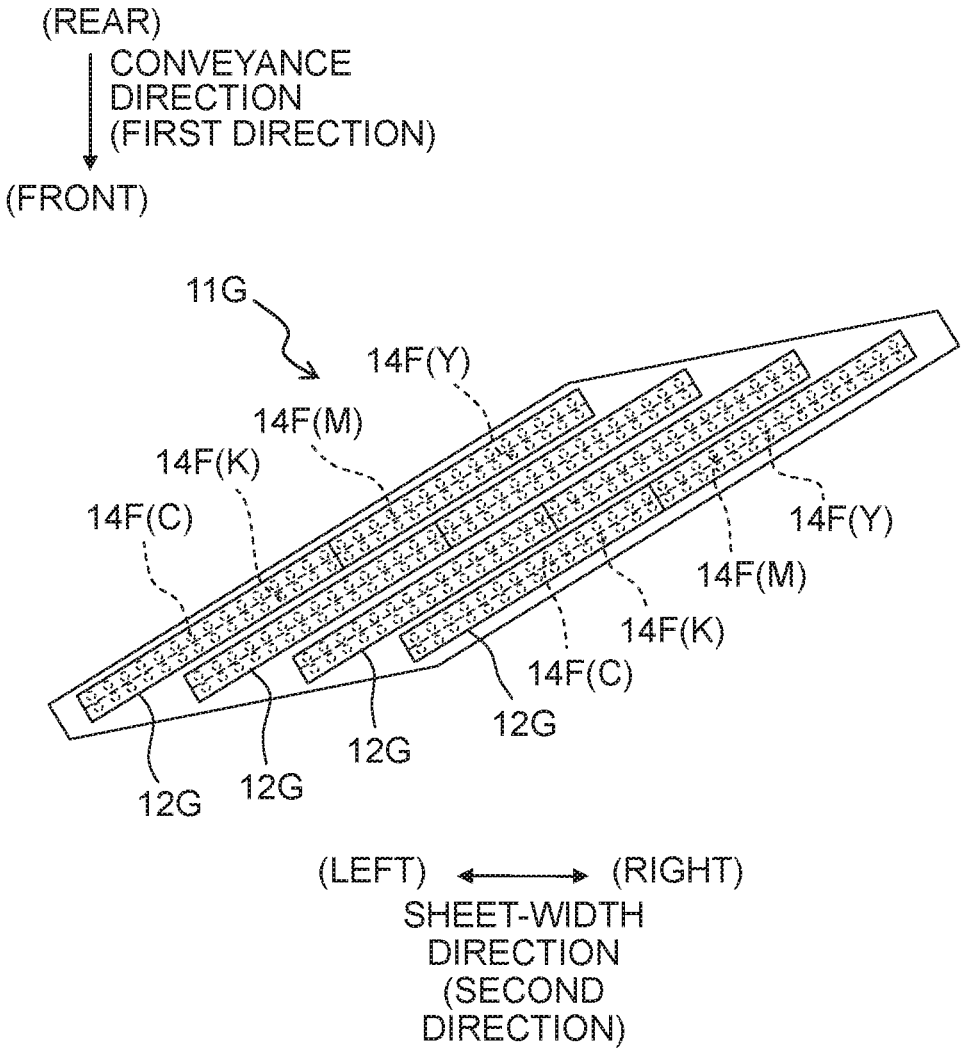
FIG. 13 is a top view depicting modification of the head unit of FIG. 12.

Further, as a modification of the configuration of FIG. 11, it is allowable that, as in a head unit 11F of FIG. 12, one nozzle chip 12F is configured to have two nozzle rows. The configuration of FIG. 12 is similar to that in FIG. 11 in that the kinds of the ink jetted are different on one side and the other side in the chip longitudinal direction of two nozzle rows. Note that, however, in the configuration of FIG. 12, two nozzle chips 12Fa configured to jet black and yellow inks and two nozzle chips 12Fb configured to jet cyan and magenta inks are arranged alternately in the sheet-width direction. Namely, between the two nozzle chips 12Fa, one of another nozzle chips 12Fb jetting the inks different from those jetted from the two nozzle chips 12Fa is arranged. In this configuration, since four color inks can be jetted from one head unit 11F, it is possible to construct a four color-printing while making the length in the conveyance direction to be small as compared with the configuration wherein four color ink jet heads are arranged side by side in the conveyance direction. Furthermore, as a modification of FIG. 12, it is allowable that the colors of the inks jetted from two nozzle rows included in one nozzle chip 12G, for example as in a head unit 11G depicted in FIG. 13, may be different from each other on one side and the other side in the chip longitudinal direction of two nozzle rows and on one side and the other side in the short direction of the two nozzle rows. Specifically, in a left-side nozzle row included in one nozzle chip 12G, nozzles 14F arranged on the front side jet the cyan ink, and nozzle 14F arranged on the rear side jet the magenta ink. On the other hand, in a right-side nozzle row included in one nozzle chip 12G, nozzles 14F arranged on the front side jet the black ink, and nozzle 14F arranged on the rear side jet the yellow ink. Namely, it is allowable that four color inks are jetted from one nozzle chip 12G. Moreover, as a modification of FIG. 13, it is allowable that two nozzle rows included in one nozzle chip 12G are divided into three or more nozzle groups, and different color inks are jetted from the three or more nozzle groups, respectively. Namely, it is allowable that six or more color inks are jetted from one nozzle chip 12G.

What is claimed is:

1. A liquid jetting apparatus configured to jet liquid onto a recording medium conveyed in a first direction, the liquid jetting apparatus comprising head units arranged side by side in a second direction orthogonal to the first direction, wherein each of the head units includes nozzle chips, each of the nozzle chips has a nozzle arrangement area in which nozzles are aligned in a third direction crossing both of the first and second directions, in each of the head units, each of the nozzle chips is arranged to be shifted relative to another nozzle chip included in the nozzle chips, in a direction which crosses both of the first and second directions and which is different from the third direction, the nozzle chips included in each of the head units include a first nozzle chip and a second nozzle chip which are adjacent to each other in the second direction, and each of the head units has a first overlapping portion in which the nozzle arrangement area of the first nozzle chip and the nozzle arrangement area of the second nozzle chip partially overlap with each other in the first direction, and the head units include a first head unit and a second head unit which are adjacent to each other in the second direction, and the liquid jetting apparatus has a second overlapping portion in which the nozzle arrangement area of a third nozzle chip and the nozzle arrangement area of a fourth nozzle chip partially overlap with each other in the first direction, the third nozzle chip being included in the nozzle chips of the first head unit and the fourth nozzle chip being included in the nozzle chips of the second head unit.

2. The liquid jetting apparatus according to claim 1, wherein length in the second direction of the second overlapping portion is not less than length in the second direction of the first overlapping portion.

3. The liquid jetting apparatus according to claim 1, wherein length in the second direction of the second overlapping portion is not less than 10% of length in the second direction of the nozzle arrangement area of each of the plurality of nozzle chips.

4. The liquid jetting apparatus according to claim 1, wherein the nozzle chips are provided as three or more nozzle chips in each of the head units;

the three or more nozzle chips are arranged with equal spacing distances therebetween in a predetermined fourth direction which crosses each of the first and second directions and which is different from the third direction.

5. The liquid jetting apparatus according to claim 4, wherein an inclination angle of the third direction relative to the second direction is greater than 0 degrees and smaller than 45 degrees.

6. The liquid jetting apparatus according to claim 4, wherein an inclination angle of the third direction relative to the second direction is not less than 45 degrees and less than 90 degrees.

7. The liquid jetting apparatus according to claim 6, wherein an inclination angle of the fourth direction relative to the second direction is greater than 45 degrees and smaller than 90 degrees.

8. The liquid jetting apparatus according to claim 6, wherein an inclination angle of the fourth direction relative to the second direction is greater than 0 degrees and not greater than 45 degrees.

9. The liquid jetting apparatus according to claim 1, wherein the head units have a same arrangement of the nozzle chips with respect to the first and second directions.

10. The liquid jetting apparatus according to claim 1, wherein the head units include three or more head units, and the second overlapping portion is provided as two or more second overlapping portions in the liquid jetting apparatus, and the two or more second overlapping portions all have a same length in the second direction.

11. The liquid jetting apparatus according to claim 1, wherein length in the third direction of the nozzle arrangement area is same regarding all of the nozzle chips included in the head units.

12. The liquid jetting apparatus according to claim 1, further comprising a controller configured to control the head units, wherein in the first overlapping area, the controller is configured to cause both of the first and second nozzle chips to jet the liquid, and in the second overlapping area, the controller is configured to cause both of the third and fourth nozzle chips to jet the liquid.

13. The liquid jetting apparatus according to claim 12, wherein in the first overlapping area, the controller is configured to cause an amount of the liquid to be jetted per unit area of the recording medium to be smaller than that in a non-overlapping area which is different from the first overlapping area and in which the nozzle arrangement area of the first nozzle chip and the nozzle arrangement area of the second nozzle chip are not overlapped in the first direction, and in the second overlapping area, the controller is configured to cause the amount of the liquid to be jetted per unit area of the recording medium to be smaller than that in another non-overlapping area which is different from the second overlapping area and in which the nozzle arrangement area of the third nozzle chip and the nozzle arrangement area of the fourth nozzle chip are not overlapped in the first direction.

14. The liquid jetting apparatus according to claim 13, wherein in the second overlapping area, the controller is configured to make the amount of the liquid to be jetted per unit area of the recording medium to be smaller than that in the first overlapping area.

15. A liquid jetting apparatus configured to jet liquid onto a recording medium conveyed in a first direction, the liquid jetting apparatus comprising head units arranged side by side in a second direction orthogonal to the first direction, wherein each of the head units includes nozzle chips, each of the nozzle chips has a nozzle arrangement area in which nozzles are aligned in a third direction crossing both of the first and second directions, the nozzle chips in each of the head units include outermost nozzle chips which are arranged respectively on outermost sides in the second direction to be shifted from each other in the first direction, the nozzle chips included in each of the head units include a first nozzle chip and a second nozzle chip which are adjacent to each other in the second direction, and each of the head units has a first overlapping portion in which the nozzle arrangement area of the first nozzle chip and the nozzle arrangement area of the second nozzle chip partially overlap with each other in the first direction, and the head units include a first head unit and a second head unit which are adjacent to each other in the second direction, and the liquid jetting apparatus has a second overlapping portion in which the nozzle arrangement area of a third nozzle chip and the nozzle arrangement area of a fourth nozzle chip partially overlap with each other in the first direction, the third nozzle chip being included in the nozzle chips of the first head unit and the fourth nozzle chip being included in the nozzle chips of the second head unit.

* * * * *